US012703889B2

(12) United States Patent
Na et al.

(10) Patent No.: US 12,703,889 B2
(45) Date of Patent: Aug. 11, 2026

(54) HIGH STRENGTH HOT-ROLLED STEEL SHEET HAVING EXCELLENT WORKABILITY, AND METHOD FOR MANUFACTURING THE SAME

(71) Applicant: POSCO, Pohang-si (KR)

(72) Inventors: Hyun-Taek Na, Gwangyang-si (KR); Sung-Il Kim, Gwangyang-si (KR); Gyu-Yeol Bae, Incheon (KR)

(73) Assignee: POSCO CO., LTD, Pohang-si (KR)

( * ) Notice: Subject to any disclaimer, the term of this patent is extended or adjusted under 35 U.S.C. 154(b) by 1452 days.

(21) Appl. No.: 17/415,535

(22) PCT Filed: Nov. 1, 2019

(86) PCT No.: PCT/KR2019/014669
§ 371 (c)(1),
(2) Date: Jun. 17, 2021

(87) PCT Pub. No.: WO2020/130329
PCT Pub. Date: Jun. 25, 2020

(65) Prior Publication Data

US 2022/0064750 A1 Mar. 3, 2022

(30) Foreign Application Priority Data

Dec. 18, 2018 (KR) ..... 10-2018-0163898

(51) Int. Cl.
*C22C 38/34* (2006.01)
*C21D 1/84* (2006.01)
(Continued)

(52) U.S. Cl.
CPC ..... *C21D 9/46* (2013.01); *C21D 1/84* (2013.01); *C21D 6/002* (2013.01); *C21D 6/005* (2013.01);
(Continued)

(58) Field of Classification Search
CPC ..... C22C 38/02; C22C 38/34; C21D 8/0226; C21D 8/0263; C21D 8/0426;
(Continued)

(56) References Cited

U.S. PATENT DOCUMENTS 6,280,538 B1 8/2001 Soshiroda et al.
2009/0223609 A1 9/2009 Hakomori et al.
(Continued)

FOREIGN PATENT DOCUMENTS

CN 101319295 12/2008
CN 105849295 8/2016
(Continued)

OTHER PUBLICATIONS

Hashimoto, et al., Effects of Nb and Mo Addition to 0.2%C-1.5% Si-1.5%Mn Steel on Mechanical Properties of Hot Rolled TRIP-aided Steel Sheets, ISIJ International, 2004, vol. 44, No. 9, pp. 1590-1598.
(Continued)

*Primary Examiner* — Vanessa T. Luk
(74) *Attorney, Agent, or Firm* — CANTOR COLBURN LLP

(57) ABSTRACT

Provided is a steel material that may be used for arms, frames, beams, brackets, reinforcing materials, etc. of chassis parts of a vehicle and, more specifically, to a high strength hot-rolled steel sheet having excellent workability and a method for manufacturing same. The steel sheet includes: by weight %, 0.1-0.15% of C, 2.0-3.0% of Si, 0.8-1.5% of Mn, 0.001-0.05% of P, 0.001-0.01% of S, 0.01-0.1% of Al, 0.7-1.7% of Cr, 0.0001-0.2% of Mo, 0.02-0.1% of Ti, 0.01-0.03% of Nb, 0.001-0.005% of B, 0.1-0.3% of V, 0.001-0.01% of N, and a balance of Fe and inevitable impurities, wherein tensile strength (TS) is 1180 MPa or more, a product (TS×El) of tensile strength and
(Continued)

elongation is 20,000 MPa % or more, and a product (TS× HER) of tensile strength and hole expandability is 30,000 MPa % or more.

7 Claims, 2 Drawing Sheets

(51) Int. Cl.

| | |
|---|---|
| ***C21D 6/00*** | (2006.01) |
| ***C21D 8/02*** | (2006.01) |
| ***C21D 8/0221*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C21D 8/02* (2013.01); *C21D 8/0226* (2013.01); *C22C 38/001* (2013.01); *C22C 38/002* (2013.01); *C22C 38/02* (2013.01); *C22C 38/04* (2013.01); *C22C 38/06* (2013.01); *C22C 38/34* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/002* (2013.01); *C21D 2211/004* (2013.01)

(58) Field of Classification Search
CPC .. C21D 8/0463; C21D 9/46; C21D 2211/002; C21D 2211/004
See application file for complete search history.

(56) References Cited

U.S. PATENT DOCUMENTS

| | | | |
|---|---|---|---|
| 2014/0014236 | A1 | 1/2014 | Nozaki et al. |
| 2015/0203946 | A1 | 7/2015 | Hammer et al. |
| 2018/0237874 | A1 | 8/2018 | Yamazaki et al. |
| 2020/0024683 | A1 | 1/2020 | Yokoi et al. |
| 2020/0080167 | A1 | 3/2020 | Kim et al. |

FOREIGN PATENT DOCUMENTS

| | | |
|---|---|---|
| CN | 106119700 | 11/2016 |
| CN | 107849663 | 3/2018 |
| CN | 108950423 | 12/2018 |
| EP | 1375694 | 1/2004 |
| EP | 3276030 | 1/2018 |
| EP | 3395992 | 10/2018 |
| EP | 3561101 | 10/2019 |
| JP | H06145894 | 5/1994 |
| JP | 2002105593 | 4/2002 |
| JP | 2005298956 | 10/2005 |
| JP | 2005314796 | 11/2005 |
| JP | 2008285748 | 11/2008 |
| JP | 2010138421 | 6/2010 |
| JP | 2012251201 | 12/2012 |
| JP | 2014224317 | 12/2014 |
| JP | 2017145467 | 8/2017 |
| JP | 2017186634 | 10/2017 |
| KR | 20010020169 | 3/2001 |
| KR | 20120049993 | 5/2012 |
| KR | 20130125821 | 11/2013 |
| KR | 20150038426 | 4/2015 |
| KR | 20150112512 | 10/2015 |
| KR | 20180068099 | 6/2018 |
| KR | 20180071866 | 6/2018 |
| WO | 2017017933 | 2/2017 |
| WO | 2018179387 | 10/2018 |

OTHER PUBLICATIONS

Im, et al., Modelling the Kinetics of Phase Transformation of Bainitic TRIP Steels in Hot Rolling Process, AISTech Conference, May 5-8, 2008.

International Search Report—PCT/KR2019/014669 dated Feb. 10, 2020.

European Search Report—European Application No. 19899913.8 issued on Sep. 29, 2021, citing WO 2018/110853, WO 2018/179387, EP 3395992, EP 3276030, JP 2005-298956, and EP 0997548.

Chinese Office Action—Chinese Application No. 201980063772.7 issued on Apr. 28, 2022, citing CN 106119700, CN 105849295, CN 107849663, CN 101319295, JP 2005-298956, KR 10-2018-0068099, and U.S. Pat. No. 6280538.

Japanese Office Action—Japanese Application No. 2021-532020 issued on Jun. 28, 2022, citing WO 2017/017933, JP 2017-145467, JP 2012-251201, JP 2005-314796, JP 2017-186634, JP 2014-224317, and EP 1375694.

HIGH STRENGTH HOT-ROLLED STEEL SHEET HAVING EXCELLENT WORKABILITY, AND METHOD FOR MANUFACTURING THE SAME

TECHNICAL FIELD

The present disclosure relates to a steel material which may be used for arms, frames, beams, brackets, reinforcements of chassis components of vehicles, and more particularly, to a high strength hot-rolled steel sheet having excellent workability, and a method for manufacturing the same.

BACKGROUND ART

Recently, demand for an increase in fuel efficiency of internal combustion engine vehicles and reductions in the weight of transportation engines, due to the weight of batteries in electrical vehicles, has been continuously increased. Also, automotive chassis components have been designed to have a reduced thickness according to higher strength. To secure safety of passengers by the reduction of thickness, steel sheets having been developed to date may exceed 750 MPa and 980 MPa grades in terms of tensile strength, and development of a high strength steel sheet of 1180 MPa grade has been necessary. However, in the case of simply increasing strength based on the techniques having developed so far, formability such as elongation and hole expandability may degrade, which may be problematic.

A technique for securing excellent elongation by the phenomenon of transformation induced plasticity (TRIP) by forming retained austenite in a structure to secure formability for a high strength steel sheet has been developed (References 1 to 3). The main features of these techniques are to secure elongation by forming relatively coarse and equiaxed crystal-shaped retained austenite on a certain fraction of polygonal ferrite and high-angle grain boundaries in a microstructure However, when a component is processed, retained austenite may be easily transformed into martensite by the above-mentioned transformation induced plasticity phenomenon, such that, due to a large difference in hardness with polygonal ferrite, hole expandability, which represents burring properties close to an actual formability mode, may greatly degrade when chassis components are processed.

To overcome this, a technique of securing elongation and hole expandability by reducing a difference in phase hardness between retained austenite and a low-temperature ferrite, or between retained austenite and bainite by increasing fractions of the low-temperature ferrite and bainite in a steel sheet has been developed (Reference 4).

However, to prevent transformation of polygonal ferrite, the technique may include a method of rapid cooling after rolling, such that an additional cooling facility device may be inevitable, which may cause a limitation in productivity, and it may not be easily to uniformly secure various physical properties such as strength in a coil and hole expandability due to rapid cooling immediately after rolling.

PRIOR ART DOCUMENT

Reference (Reference 1) Japanese Laid-Open Patent Publication No. 1994-145894

(Reference 2) Japanese Laid-Open Patent Publication No. 2008-285748

(Reference 3) Korean Laid-Open Patent Publication No. 10-2012-0049993

(Reference 4) Japanese Laid-Open Patent Publication No. 2012-251201

DISCLOSURE

Technical Problem

An aspect of the present disclosure is to provide a hot-rolled steel sheet having high strength and excellent formability of elongation and hole expandability, and a method for manufacturing the same.

The purpose of the present disclosure is not limited to the above description. A person skilled in the art to which the present disclosure belongs will not have any difficulty in understanding an additional purpose of the present disclosure from the general matters in the present specification.

Technical Solution

An aspect of the present disclosure relates to a high strength hot-rolled steel sheet having excellent formability including, by weight %, 0.1-0.15% of C, 2.0-3.0% of Si, 0.8-1.5% of Mn, 0.001-0.05% of P, 0.001-0.01% of S, 0.01-0.1% of Al, 0.7-1.7% of Cr, 0.0001-0.2% of Mo, 0.02-0.1% of Ti, 0.01-0.03% of Nb, 0.001-0.005% of B, 0.1-0.3% of V, 0.001-0.01% of N, and a balance of Fe and inevitable impurities, wherein [relational expression 1] and [relational expression 2] are satisfied, and wherein tensile strength (TS) is 1180 MPa or more, a product (TS×El) of tensile strength and elongation is 20,000 MPa % or more, and a product (TS×HER) of tensile strength and hole expandability is 30,000 MPa % or more.

$$20 \le H\gamma \le 50$$

$$H\gamma = 194.5 - (428[C] + 11[Si] + 45[Mn] + 35[Cr] - 10[Mo] - 107[Ti] - 56[Nb] - 70[V]) \quad \text{[Relational expression 1]}$$

(where [elemental symbol] indicates a content (weight %) of each element)

$$0.7 \le a_p \le 3.5$$

$$a_p = ([Mo]+[Ti]+[Nb]+[V]) \times [C]^{-1} \quad \text{[Relational expression 2]}$$

(where [elemental symbol] indicates a content (weight %) of each element)

Another aspect of the present disclosure relates to a method for manufacturing a high strength hot-rolled steel sheet having excellent formability, the method including heating a steel slab satisfying the above alloy composition and relational expression 1 and relational expression 2 at 1180-1300° C.;

starting hot rolling of the heated slab at Ar3 or higher, and finishing hot rolling the slab under a condition satisfying [Relational expression 3] as below;

performing cooling (primary cooling) at a cooling rate of 20-400° C./s to a temperature range of 500-600° C. after the hot rolling;

performing cooling (secondary cooling) to a temperature range of 350-500° C. after the primary cooling; and performing coiling at a temperature of 350-500° C.

$$900 \leq T^* \leq 960$$

$$T^* = T + 225[C]^{0.5} + 17[Mn] - 34[Si] - 20[Mo] - 41\{V\} \quad \text{[Relational expression 3]}$$

(where "T" indicates a hot finishing rolling temperature (FDT), and [elemental symbol] indicates a content (weight %) of each element)

Advantageous Effects

A hot-rolled steel sheet in the present disclosure may have advantages of having excellent strength and also excellent formability. Therefore, using the hot-rolled steel sheet of the present disclosure, high strength and a reduced thickness may be obtained with respect to vehicle chassis components.

BEST MODE FOR INVENTION

Figure 1:
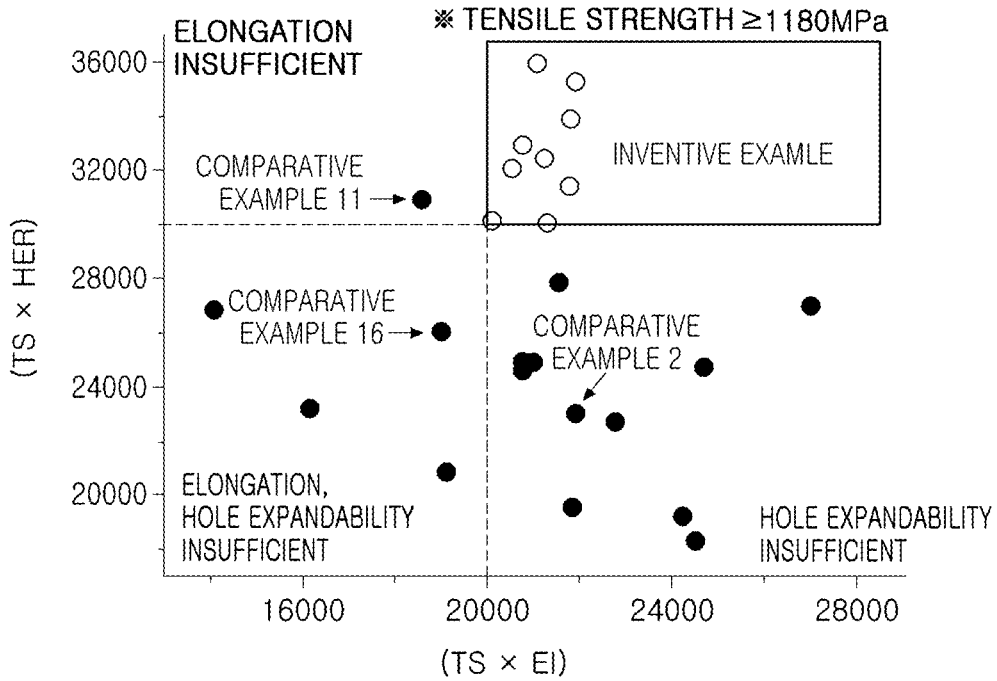
FIG. 1 is a graph illustrating a distribution of a product (TS×El) of tensile strength and elongation, and a product (TS×HER) of tensile strength and hole expandability of inventive examples and comparative examples respectively in the present Example.

General transformation induced plasticity (TRIP) steel may be applied to vehicle components requiring high ductility during forming components, and may be required to have a reduced thickness of less than 2.5 mmt level due to characteristics of the components. For this reason, cold rolling may be performed after hot rolling, and thereafter, a structure may be formed through a heat treatment process of an annealing process in which temperature and a speed of passing sheet may be controlled in a stable manner relatively. However, when the steel is used for chassis components as in the present disclosure, generally, a thickness may be in a range of 1.5-5 mmt, and in some cases, the thickness may be greater than this, such that it may not be suitable to manufacture the components by cold rolling. Also, the chassis components may need to secure ductility and also excellent hole expandability when a steel sheet is manufactured, and thus, retained austenite may need to be appropriately formed metallurgically, and it may be also necessary to reduce a difference in hardness between retained austenite and a matrix structure. The present disclosure has been devised to overcome the above-described technical difficulties, to implement TRIP properties for a hot-rolled steel sheet, and to secure excellent hole expandability.

In the description below, the present disclosure will be described in greater detail.

An alloy composition of the hot-rolled steel sheet of the present disclosure will be described in detail. The hot-rolled steel sheet of the present disclosure may include, by weight %, 0.1-0.15% of C, 2.0-3.0% of Si, 0.8-1.5% of Mn, 0.001-0.05% of P, 0.001-0.01% of S, 0.01-0.1% of Al, 0.7-1.7% of Cr, 0.0001-0.2% of Mo, 0.02-0.1% of Ti, 0.01-0.03% of Nb, 0.001-0.005% of B, 0.1-0.3% of V, 0.001-0.01% of N, and a balance of Fe and inevitable impurities.

Carbon (C): 0.1-0.15 Weight % (Hereinafter, Referred to as %)

C may be the most economical and effective for strengthening steel. When the amount of added C is increased, a fraction of bainite may increase, such that strength may increase, and the formation of retained austenite may be facilitated, which may be advantageous in securing an elongation based on a transformation induced plasticity effect. However, when the content is less than 0.1%, fractions of bainite and retained austenite may not be sufficiently secured during cooling after hot rolling, and formation of polygonal ferrite may occur by a decrease in hardenability. When the content exceeds 0.15%, strength may excessively increase due to an increase of a fraction of martensite, and weldability and formability may be deteriorated. Therefore, the content of C may preferably be 0.1-0.15%.

Silicon (Si): 2.0-3.0%

Si may deoxidize molten steel and may contribute to an increase in strength through a solid solution strengthening effect. Also, Si may inhibit the formation of carbides in a structure and may facilitate the formation of retained austenite during cooling. However, when the content is less than 2.0%, the effect of inhibiting the formation of carbides in the structure and securing stability of retained austenite may be reduced. When the content exceeds 3.0%, ferrite transformation may be excessively promoted, such that fractions of bainite and retained austenite in the structure may rather decrease, and it may be difficult to secure sufficient physical properties. Also, red scale may be formed by Si on the surface of the steel sheet, such that the surface of the steel sheet may be deteriorated and weldability may be deteriorated, which may be problematic. Therefore, the content of Si may preferably be 2.0-3.0%.

Manganese (Mn): 0.8-1.5%

Similarly to Si, Mn may be effective in solid solution strengthening of steel, and may improve hardenability of steel such that bainite or retained austenite may be easily formed during cooling after hot rolling. However, when the content is less than 0.8%, the above effect may not be obtained by the addition of Mn, and when the content exceeds 1.5%, a fraction of martensite may increase, and also the segregation region may be greatly developed in a center of a thickness during slab casting in a continuous casting process such that formability may degrade, which may be problematic. Therefore, the content of Mn may preferably be 0.8-1.5%.

Phosphorus (P): 0.001-0.05%

P may be one of impurities present in steel, and when the content thereof exceeds 0.05%, ductility may decrease due to micro-segregation and impact properties of steel may degrade. To manufacture steel with less than 0.001% of P, it may take a lot of time and effort in steelmaking operation, which may greatly reduce productivity. Therefore, the P content may preferably be 0.001-0.05%.

Sulfur (S): 0.001-0.01%

S may be one of impurities present in steel, and when the content thereof exceeds 0.01%, S may be combined with manganese and may form non-metallic inclusions, and accordingly, toughness of the steel may significantly degrade. To manage the content to be less than 0.001%, it may take a lot of time and effort in steelmaking operation, which may greatly reduce productivity. Therefore, the content of S may preferably be 0.001-0.01%.

Aluminum (Al): 0.01-0.1%

Aluminum (preferably, Sol.Al) may be mainly added for deoxidation, and preferably, 0.01% or more of Al may be added to expect a sufficient deoxidation effect. However, when the content exceeds 0.1%, which is excessive, Al may be bonded with nitrogen such that AlN may be formed, and slab corner cracks may be likely to be formed during continuous casting, and defects may occur due to the formation of inclusions. Therefore, preferably, the content may be 0.1% or less. Thus, the content of Al may be 0.01-0.1%.

Chrome (Cr): 0.7-1.7%

Cr may solid-solution strengthen steel and, similarly to Mn, may delay phase transformation of ferrite during cooling such that Cr may contribute to forming bainite and retained austenite. To obtain the above effect, preferably, 0.7% or more of Cr may be added. However, when the content exceeds 1.7%, an elongation rate may decrease rapidly due to an excessive increase in phase fractions of bainite and martensite. Therefore, the Cr content may preferably be 0.7-1.7%.

Molybdenum (Mo): 0.0001-0.2%

Mo may increase hardenability of steel such that formation of bainite may be facilitated. To this end, preferably, 0.0001% or more of Mo may be added. However, when the content exceeds 0.2%, hardenability may increase such that martensite may be formed, which may lead to degradation of formability and may be disadvantageous in terms of economic efficiency and weldability. Therefore, the content of Mo may preferably be 0.0001-0.2%.

Titanium (Ti): 0.02-0.1%

Ti may be a representative precipitation enhancing element along with Nb and V, and may forms coarse TiN in steel with strong affinity with N. TiN may contribute to inhibiting growth of crystal grains during a heating process for hot rolling. Ti remaining after reacting with N may be dissolved in steel and may be bonded with carbon such that TiC precipitates may be formed, and TiC precipitates may improve strength of steel. To obtain the technical effect in the present disclosure, preferably, Ti may be added in an amount of 0.02% or more. However, when the content exceeds 0.1%, precipitation of TiN or TiC may be excessive, such that the solid solution C content required for formation of bainite and retained austenite in steel may decrease rapidly, and hole expandability may decrease. Therefore, the content of Ti may preferably be 0.02-0.1%.

Niobium (Nb): 0.01-0.03%

Nb may be a representative precipitation strengthening element along with Ti and V. Nb may be precipitated during hot rolling and may refine crystal grains by delaying recrystallization, such that strength and impact toughness of steel may improve. To obtain the above effect, preferably, Nb may be added in an amount of 0.01% or more. However, when the content exceeds 0.03%, the solid solution C content in steel during hot rolling may be rapidly reduced, such that it may be impossible to secure sufficient bainite and retained austenite, and due to excessive delay of recrystallization, elongated crystal grains may be formed, which may deteriorate formability. Therefore, the content of Nb may preferably be 0.01-0.03%.

Boron (B): 0.001-0.005%

B may be effective in securing hardenability of steel, and when B is present in a solid solution state, B may stabilize grain boundaries, such that brittleness of steel in a low-temperature region may improve. Also, B may form BN along with solid solution N, such that formation of coarse nitride may be prevented. To obtain the effect, preferably, 0.001% or more of B may be included. When the content exceeds 0.005%, recrystallization behavior may be delayed during hot rolling and a precipitation strengthening effect may be reduced. Therefore, the content of B may preferably be 0.001-0.005%.

Vanadium (V): 0.1-0.3%

V may be a representative precipitation enhancing element along with Ti and Nb, and may improve strength of steel by forming precipitates after coiling. To obtain the effect, 0.1% or more of V may be added preferably. When the content exceeds 0.3%, coarse composite precipitates may be formed, such that formability may degrade, which may be economically disadvantageous. Therefore, the content of V may preferably be 0.1-0.3%.

Nitrogen (N): 0.001-0.01%

N may be a representative solid solution strengthening element along with carbon, and may form coarse precipitates along with Ti and Al. Generally, a solid solution strengthening effect of nitrogen may be higher than that of carbon, but since toughness may decrease significantly when the amount of nitrogen in the steel increases, preferably, N may be added in an amount of 0.01% or less. To manufacture steel with the content of N to be less than 0.001%, it may take a lot of time for steelmaking operation, such that productivity may degrade. Therefore, the content of N may preferably be 0.001-0.01%.

A remainder may include Fe and inevitable impurities. In a range in which the technical effect of the present disclosure is not impaired, alloy components which may be additionally included in addition to the above-described alloy components may not be excluded.

Preferably, the alloy composition in the hot-rolled steel sheet of the present disclosure may satisfy [relational expression 1] and [relational expression 2] as below.

$$20 \le H\gamma \le 50$$

$$H\gamma = 194.5 - (428[C] + 11[Si] + 45[Mn] + 35[Cr] - 10[Mo] - 107[Ti] - 56[Nb] - 70[V]) \quad \text{[Relational expression 1]}$$

In relational expression 1, [elemental symbol] may indicate a content (weight %) of each element.

In relational expression 1, Hγ is a relational expression of an effect of securing retained austenite stability by adding C, Si, Mn, Cr, Mo, Nb, and V, which are hardenability enhancing elements and an effect of reducing a difference in hardness between retained austenite and a matrix structure adjacent to retained austenite having precipitates in grains of the structure, by adding the elements.

In relational expression 1, when Hγ is less than 20, a hardenability effect may be high such that stability of retained austenite may be secured, but due to concentration of excessive alloy components in a retained austenite grain, retained austenite may be rapidly hardened. For this reason, a difference in hardness between retained austenite and ferrite, or between retained austenite and bainite may increase, and hole expandability of the steel sheet may be deteriorated. When Hγ exceeds 50, precipitates may be excessively formed in a structure adjacent to retained austenite, such that carbon content in the retained austenite may be insufficient, and stability of the retained austenite may be deteriorated, which may degrade elongation.

Preferably, to form an appropriate fraction of a precipitate in a structure adjacent to retained austenite, [relational expression 2] may be satisfied in addition to [relational expression 1].

$$0.7 \le a_p \le 3.5$$

$$a_p = ([Mo] + [Ti] + [Nb] + [V]) \times [C]^{-1} \quad \text{[Relational expression 2]}$$

In relational expression 2, [elemental symbol] indicates a content (weight %) of each element.

When a value of $a_p$ is less than 0.7, sufficient precipitates may not be formed in a structure adjacent to retained austenite, and when the value exceeds 3.5, precipitation may be excessive such that stability of the aforementioned retained austenite may be deteriorated.

A microstructure of the hot-rolled steel sheet of the present disclosure may include, by an area fraction, 5-15% of ferrite, 5-20% of retained austenite, and 10% or less of inevitable structure, in addition to bainite as a matrix structure. The inevitable structure may include martensite, a martensite austenite constituent (MA), or the like, and a sum of thereof may not exceed 10% preferably. When the sum exceeds 10%, elongation may be deteriorated due to a decrease in a fraction of retained austenite, and also hole expandability may be deteriorated due to a difference in hardness between retained austenite and ferrite, or between retained austenite and bainite.

When a fraction of ferrite is less than 5%, most of elongation of the steel sheet may be dependent on retained austenite, such that it may be difficult to secure a level of elongation targeted in the present disclosure. When the content exceeds 15%, it may be difficult to secure sufficient strength. When the retained austenite is less than 5%, a fraction of an excessive low-temperature transformation phase such as martensite in a microstructure may increase, such that it may be easy to secure strength, but elongation may be deteriorated. When a fraction of retained austenite exceeds 20%, stability may be deteriorated due to a decrease in the carbon content in each retained austenite, and accordingly, most of the structure may be stress induced-transformed into martensite in an initial stage of deformation, such that ductility may degrade.

Preferably, an average hardness value of ferrite may be 200 Hv or more. When hardness value is less than 200 Hv, hole expandability may degrade due to a high difference in hardness between bainite and retained austenite. To secure the average hardness value of the ferrite, it may be important to secure a fraction of low angle grain boundary fraction, dislocation density, and precipitates in the ferrite, and to this end, a design of components of the steel sheet and also an optimized process may be necessary when the steel sheet is manufactured.

Preferably, in the hot-rolled steel sheet of the present disclosure, the number of precipitates having a diameter of 5 nm or more in ferrite present within 100 μm from a retained austenite grain boundary in the microstructure may be $5\times10^n/mm^2$ ($1\leq n\leq 3$). When the number of precipitates is less than an effective range, the effect of reducing a difference in hardness between retained austenite and the structure adjacent to retained austenite may be insufficient, such that it may be difficult to secure hole expandability. When the number of precipitates exceeds an effective range, a fraction of retained austenite and bainite may degrade due to excessive precipitation, such that strength and ductility may be deteriorated.

The type of the precipitate is not particularly limited, and may be a carbide, nitride, or the like, including Mo, Ti, Nb, and V.

Preferably, the hot-rolled steel sheet of the present disclosure may have tensile strength (TS) of 1180 MPa or more, a product (TS×El) of tensile strength and elongation may be 20,000 MPa % or more, and a product (TS×HER) of tensile strength and hole expandability may be 30,000 MPa % or more.

In the description below, an example of manufacturing the present disclosure hot-rolled steel sheet will be described in detail. The hot-rolled steel sheet of the present disclosure may be manufactured through a process comprising the steps of heating a steel slab satisfying the above-described alloy composition-hot rolling the heated steel slab-cooling the hot rolled steel sheet-coiling the cooled steel sheet. In the description below, each of the above processes will be described in detail.

A steel slab having the above-described alloy composition may be prepared, and the steel slab may be heated to a temperature of 1180-1300° C. preferably. When the heating temperature is less than 1180° C., heat of the steel slab may be insufficient such that it may be difficult to secure the temperature during hot rolling, and it may be difficult to remove segregation via diffusion generated during continuous casting. Also, precipitates precipitated during continuous casting may not be sufficiently re-solid solute, such that it may be difficult to obtain a precipitation strengthening effect in a process after hot rolling. When the content exceeds 1300° C., strength may be reduced and a structure may be formed non-uniformly due to coarse growth of austenite grains, and thus, the slab heating temperature may preferably be 1180-1300° C.

The heated steel slab may be hot-rolled. Preferably, hot rolling the heated steel slab may be started in a temperature range equal to or higher than a ferrite phase transformation initiation temperature (Ar3), and a hot finishing rolling temperature may be managed within a temperature range satisfying [relational expression 3] as below.

$$900\leq T^*\leq 960$$

$$T^*=T+225[C]^{0.5}+17[Mn]-34[Si]-20[Mo]-41\{V] \quad \text{[Relational expression 3]}$$

(where "T" indicates a hot finishing rolling temperature (FDT), and [elemental symbol] indicates a content (weight %) of each element).

When the finishing temperature after the rolling is less than the range of the relational expression 3, a fraction of coarse and elongated ferrite may increase, such that it may be difficult to secure target strength and formability. When the range of the relational expression 3 is exceeded, strength may degrade due to formation of a coarse structure at a high rolling temperature, and scaling surface defects may increase, such that formability may degrade from another viewpoint.

T* may be an effective temperature range for inhibiting formation of coarsely elongated ferrite by phase transformation in a two phase region which may occur before or during rolling. When an alloying element that delays ferrite transformation such as C or Mn is added, a range thereof may increase, but when the content of Si that promotes ferrite transformation increases, the range may decrease. Also, Mo and V may increase hardenability during phase transformation, similarly to C and Mn, but Mo and V may facilitate formation of carbides by bonding with C, and C which is necessary to form bainite and retained austenite may be exhausted through the formation of carbides, such that physical properties suggested in the present disclosure may not be secured. Accordingly, when T* is less than 900, a fraction of the elongated coarse ferrite may be high, such that a fraction of bainite and uniformity of distribution behavior of retained austenite may degrade, which may degrade strength and formability. When 960 is exceeded, a high-temperature heating operation may be inevitable to secure a high rolling temperature, such that scaling defects may occur, which may deteriorate surface quality, and a coarse structure may be formed, such that it may be difficult to secure strength and formability.

The hot-rolled steel sheet may be cooled at a cooling rate of 20-400° C./s to a temperature range of 500-600° C. (primary cooling). When the primary cooling termination temperature is less than 500° C., which is rapid cooling, the steel sheet may be rapidly cooled in a transition boiling temperature range, which may shape and material uniformity may degrade. When 600° C. may be exceeded, a fraction of polygonal ferrite may excessively increase, such that it may be difficult to secure sufficient strength and hole expandability. When the primary cooling rate exceeds 400° C./s, there may be a limitation in operation of a facility, and a shape and material uniformity may degrade due to non-uniformity of ferrite and bainite transformation behavior for the excessive cooling rate. When the cooling is performed at a cooling rate of less than 20° C./s, phase transformation of ferrite and pearlite may occur during the cooling, such that a desired level of strength and hole expandability may not be secured. The primary cooling rate may be more preferably 70-400° C./s.

After the primary cooling, if necessary, to increase low-temperature ferrite formation and a precipitation effect, a process of Extremely slow cooling at a cooling rate of 0.05-4.0° C./s for 12 seconds or less may be further included. When the Extremely slow cooling exceeds 12 seconds, it may be difficult to control the cooling in an actual run out table (ROT) section, and it may be difficult to secure desired fractions of bainite and retained austenite due to an increase in an excessive increase of fraction of ferrite in the structure, such that it may be difficult to secure desired properties.

After the primary cooling, cooling (secondary cooling) may be performed at a cooling rate of 0.5-70° C./s to a temperature range of 350-500° C. In some cases, an Extremely slow cooling process may be included in the secondary cooling process. When the secondary cooling termination temperature is less than 350° C., fractions of martensite and MA phase may excessively increase, and when the temperature exceeds 500° C., fractions of bainite and retained austenite phase may not be secured, such that elongation and hole expandability may not be secured simultaneously at tensile strength of 1180 MPa or more. When the secondary cooling rate is less than 0.5° C./s, ferrite may be excessively formed, such that bainite and retained austenite may not be sufficiently secured, and it may be difficult to secure strength, and hole expansion may degrade due to a difference in hardness between phases. When the cooling rate exceeds 70° C./s, a fraction of bainite may increase and fractions of ferrite and retained austenite may decrease, such that it may be difficult to secure elongation. The secondary cooling rate may be more preferably 0.5-50° C./s.

Preferably, the hot-rolled steel sheet on which the secondary cooling has been completed may be coiled at the same temperature. Natural cooling may be performed on the coiled hot-rolled steel sheet to a temperature range of room temperature −200° C., and shape leveling may be carried out through leveler and surface layer scale may be removed by pickling or a process similar to pickling. When the temperature of the steel sheet exceeds 200° C., shape leveling may be easy during leveler, but roughness of the surface layer may be deteriorated due to over-pickling during pickling.

Also, a plated layer may be formed if necessary. The type and method of the plating are not particularly limited. However, to inhibit releasing of low-temperature transformation phases such as bainite and retained austenite during the heat treatment of the steel sheet, such as the heating for plating, the heat treatment may be performed at less than 600° C. preferably.

BEST MODE FOR INVENTION

Hereinafter, the present disclosure will be described in greater detail through embodiments. However, it should be noted that the embodiment are merely to specify the present disclosure and not to limiting the scope of the present disclosure. The scope of the present disclosure may be determined by matters described in the claims and matters reasonably inferred therefrom.

Example

A steel slab having the alloy composition (weight %, a remainder is Fe and inevitable impurities) as in Table 1 was manufactured, was heated to 1250° C., was rough-rolled, was hot-rolled to 2.5-3.5 mmt in a range in which a finishing temperature satisfies [relational expression 3], and was cooled under cooling conditions as in Table 2, thereby manufacturing a hot-rolled steel sheet. In this case, the cooling rate during the secondary cooling was controlled to be within 0.5-70° C./s, and the cooling was performed to the secondary cooling termination temperature as in Table 2, coiling was performed. Thereafter, natural cooling was performed in the air to room temperature, and shape leveling may be carried out through leveler and surface layer scale may be removed by pickling process.

For the hot-rolled steel sheet manufactured as above, a microstructure was observed using a scanning electron microscope (SEM), an area fraction was calculated using an image analyzer, and results thereof are listed in Table 3. In particular, an area fraction of an MA phase was measured using an optical microscope and an SEM at the same time after etching by the LePera etching method.

Particularly, the carbon content of retained austenite (RA) and a structure adjacent to retained austenite, and the distribution of the precipitates of the structure adjacent to retained austenite (RA) were specified using a transmission electron microscope (TEM), and in both the invention examples and comparative examples, the number of precipitates was an average value of precipitates having a diameter of 5 nm or more for 500 $nm^2$, 10 regions.

As for the rolling direction of the manufactured hot-rolled steel sheet, a JIS No. 5 standard sample was prepared with reference to 90° and 0° directions, a tensile test was performed at room temperature at a strain rate of 10 mm/min, and yield strength (YS), tensile strength (TS) and elongation (El) were measured, which may indicate 0.2% off-set yield strength, tensile strength and fracture elongation, respectively. Yield strength and tensile strength were results of evaluating a 90° sample in the rolling direction, and elongation was a result of evaluating a 0° sample in the rolling direction. The tensile strength and elongation are listed in Table 3 below.

As for hole expandability (HER), a square sample of about 120 mm in width and length was prepared, and a hole of a diameter of 10 mm was punched in a center of the sample through punching operation, a burr was disposed upward, a cone was pushed up, and a diameter of the hole immediately before cracks were created in a circumferential region for a minimum hole diameter (10 mm) was calculated in percentage and are listed in Table 3.

TABLE 1

| Classification | Composition (wt. %) | | | | | | | | | | | | | Relational expression 1 | Relational expression 2 |
|---|---|---|---|---|---|---|---|---|---|---|---|---|---|---|---|
| | C | Si | Mn | P | S | Al | Cr | Mo | Ti | Nb | B | V | N | | |
| Inventive example 1 | 0.14 | 2.4 | 1.4 | 0.01 | 0.003 | 0.04 | 1.1 | 0.11 | 0.03 | 0.021 | 0.003 | 0.12 | 0.003 | 20.6 | 2.0 |
| Inventive example 2 | 0.12 | 2.4 | 1.1 | 0.01 | 0.003 | 0.04 | 1.4 | 0.05 | 0.03 | 0.015 | 0.004 | 0.12 | 0.004 | 31.2 | 1.8 |
| Inventive example 3 | 0.11 | 2.4 | 0.9 | 0.01 | 0.003 | 0.04 | 1.4 | 0.05 | 0.04 | 0.015 | 0.002 | 0.12 | 0.003 | 45.5 | 2.0 |
| Inventive example 4 | 0.13 | 2.1 | 1.3 | 0.01 | 0.003 | 0.04 | 1.1 | 0.15 | 0.03 | 0.015 | 0.003 | 0.11 | 0.004 | 32.0 | 2.3 |
| Inventive example 5 | 0.14 | 2.2 | 1.1 | 0.01 | 0.003 | 0.04 | 1.4 | 0.07 | 0.05 | 0.021 | 0.003 | 0.14 | 0.003 | 28.9 | 2.0 |
| Inventive example 6 | 0.14 | 2.4 | 1.4 | 0.01 | 0.003 | 0.04 | 0.8 | 0.14 | 0.03 | 0.021 | 0.002 | 0.12 | 0.003 | 31.4 | 2.2 |

TABLE 1-continued

| Classification | Composition (wt. %) | | | | | | | | | | | | | Relational expression 1 | Relational expression 2 |
|---|---|---|---|---|---|---|---|---|---|---|---|---|---|---|---|
| | C | Si | Mn | P | S | Al | Cr | Mo | Ti | Nb | B | V | N | | |
| Inventive example 7 | 0.11 | 2.1 | 1.2 | 0.01 | 0.003 | 0.04 | 1.1 | 0.003 | 0.03 | 0.015 | 0.003 | 0.13 | 0.003 | 45.0 | 1.6 |
| Inventive example 8 | 0.14 | 2.9 | 0.9 | 0.01 | 0.003 | 0.04 | 1.4 | 0.003 | 0.04 | 0.015 | 0.003 | 0.19 | 0.003 | 31.6 | 1.8 |
| Inventive example 9 | 0.12 | 2.3 | 1.1 | 0.01 | 0.003 | 0.04 | 1.6 | 0.07 | 0.04 | 0.015 | 0.002 | 0.11 | 0.004 | 25.9 | 2.0 |
| Comparative example 1 | 0.24 | 2.1 | 0.9 | 0.01 | 0.003 | 0.04 | 1.1 | 0.15 | 0.03 | 0.015 | 0.003 | 0.09 | 0.004 | 1.5 | 1.2 |
| Comparative example 2 | 0.08 | 2.2 | 1.1 | 0.01 | 0.003 | 0.04 | 1.1 | 0.15 | 0.03 | 0.015 | 0.001 | 0.11 | 0.003 | 61.3 | 3.8 |
| Comparative example 3 | 0.13 | 3.4 | 1.4 | 0.01 | 0.003 | 0.04 | 1.1 | 0.15 | 0.04 | 0.015 | 0.003 | 0.14 | 0.003 | 16.4 | 2.7 |
| Comparative example 4 | 0.13 | 1.8 | 0.9 | 0.01 | 0.003 | 0.04 | 1.1 | 0.05 | 0.04 | 0.015 | 0.002 | 0.12 | 0.004 | 54.1 | 1.7 |
| Comparative example 5 | 0.13 | 2.2 | 1.7 | 0.01 | 0.003 | 0.04 | 1.1 | 0.07 | 0.04 | 0.015 | 0.003 | 0.11 | 0.004 | 13.2 | 1.8 |
| Comparative example 6 | 0.13 | 2.9 | 0.6 | 0.01 | 0.003 | 0.04 | 1.1 | 0.07 | 0.04 | 0.015 | 0.003 | 0.09 | 0.003 | 53.6 | 1.7 |
| Comparative example 7 | 0.13 | 2.1 | 1.1 | 0.01 | 0.003 | 0.04 | 1.8 | 0.15 | 0.04 | 0.015 | 0.002 | 0.14 | 0.004 | 19.7 | 2.7 |
| Comparative example 8 | 0.13 | 2.4 | 1.1 | 0.01 | 0.003 | 0.04 | 0.5 | 0.15 | 0.03 | 0.015 | 0.002 | 0.09 | 0.004 | 57.3 | 2.2 |
| Comparative example 9 | 0.14 | 2.2 | 1.1 | 0.01 | 0.003 | 0.04 | 1.1 | 0 | 0.01 | 0.005 | 0.002 | 0.09 | 0.003 | 30.0 | 0.8 |
| Comparative example 10 | 0.14 | 2.1 | 1.1 | 0.01 | 0.003 | 0.04 | 1.1 | 0.22 | 0.11 | 0.035 | 0.003 | 0.31 | 0.003 | 61.1 | 4.8 |
| Comparative example 11 | 0.13 | 2.4 | 1.1 | 0.01 | 0.003 | 0.04 | 1.4 | 0.07 | 0.03 | 0.015 | 0.003 | 0.11 | 0.003 | 26.4 | 1.7 |
| Comparative example 12 | 0.14 | 2.1 | 1.1 | 0.01 | 0.003 | 0.04 | 1.1 | 0.07 | 0.03 | 0.015 | 0.003 | 0.12 | 0.003 | 36.6 | 1.7 |
| Comparative example 13 | 0.14 | 2.1 | 1.1 | 0.01 | 0.003 | 0.04 | 1.1 | 0.07 | 0.03 | 0.015 | 0.003 | 0.12 | 0.004 | 36.6 | 1.7 |
| Comparative example 14 | 0.14 | 2.1 | 1.1 | 0.01 | 0.003 | 0.04 | 1.1 | 0.07 | 0.03 | 0.015 | 0.003 | 0.12 | 0.004 | 36.6 | 1.7 |
| Comparative example 15 | 0.14 | 2.1 | 1.1 | 0.01 | 0.003 | 0.04 | 1.1 | 0.07 | 0.03 | 0.015 | 0.003 | 0.12 | 0.003 | 36.3 | 1.7 |

(Relational expression 1 is Hγ 194.5−(428[C]+11[Si]+45[Mn]+35[Cr]−10[Mo]−107[Ti]−56[Nb]−70 [V]), and relational expression 2 is $a_p$=([Mo]+[Ti]+[Nb]+[V])×[C]$^{-1}$

TABLE 2

| Classification | FDT (T) (° C.) | Relational expression 3 T* | Primary cooling | | Extremely slow cooling | | Secondary cooling |
|---|---|---|---|---|---|---|---|
| | | | Termination temperature (° C.) | Cooling rate (° C. /s) | Intermediate temperature (° C.) | Time (sec) | Termination temperature (° C.) |
| Inventive example 1 | 931 | 950 | 591 | 85 | — | — | 453 |
| Inventive example 2 | 941 | 950 | 562 | 95 | — | — | 409 |
| Inventive example 3 | 948 | 950 | 561 | 97 | 555 | 6 | 481 |
| Inventive example 4 | 922 | 946 | 563 | 90 | 559 | 8 | 452 |

TABLE 2-continued

| Classif-ication | FDT (T) (° C.) | Relational expression 3 T* | Primary cooling Termination temperature (° C.) | Primary cooling Cooling rate (° C. /s) | Extremely slow cooling Intermediate temperature (° C.) | Extremely slow cooling Time (sec) | Secondary cooling Termination temperature (° C.) |
|---|---|---|---|---|---|---|---|
| Inventive example 5 | 929 | 950 | 582 | 87 | 577 | 8 | 466 |
| Inventive example 6 | 935 | 954 | 568 | 92 | 562 | 8 | 479 |
| Inventive example 7 | 931 | 949 | 564 | 92 | 557 | 6 | 443 |
| Inventive example 8 | 939 | 932 | 554 | 96 | 550 | 5 | 441 |
| Inventive example 9 | 940 | 953 | 533 | 102 | 525 | 5 | 446 |
| Com-parative example 1 | 902 | 949 | 559 | 86 | 553 | 8 | 449 |
| Com-parative example 2 | 935 | 935 | 531 | 101 | 526 | 8 | 458 |
| Com-parative example 3 | 933 | 914 | 551 | 96 | 545 | 8 | 428 |
| Com-parative example 4 | 924 | 953 | 584 | 85 | 576 | 8 | 466 |
| Com-parative example 5 | 912 | 941 | 550 | 91 | 541 | 8 | 439 |
| Com-parative example 6 | 936 | 924 | 573 | 91 | 567 | 6 | 455 |
| Com-parative example 7 | 918 | 938 | 562 | 89 | 555 | 6 | 449 |
| Com-parative example 8 | 927 | 939 | 578 | 87 | 571 | 6 | 463 |
| Com-parative example 9 | 923 | 947 | 585 | 85 | 570 | 8 | 465 |
| Com-parative example 10 | 931 | 945 | 562 | 92 | 565 | 8 | 477 |
| Com-parative example 11 | 880 | 892 | 568 | 78 | 563 | 6 | 418 |
| Com-parative example 12 | 924 | 949 | 670 | 64 | 635 | 6 | 425 |
| Com-parative example 13 | 924 | 949 | 562 | 91 | 556 | 15 | 441 |
| Com-parative example 14 | 928 | 953 | 610 | 80 | 558 | 0 | 311 |
| Com-parative example 15 | 921 | 946 | 616 | 76 | 599 | 8 | 550 |

Relational expression 3 is $T^*=T+225\,[C]^{0.5}+17\,[Mn]-34\,[Si]-20[Mo]-41[V]$, and the intermediate temperature refers to an intermediate point between the primary cooling termination temperature and the secondary cooling initiation temperature.

TABLE 3

| Classification | Microstructure | | | | | Rolled sheet properties | | | | |
|---|---|---|---|---|---|---|---|---|---|---|
| | F | B | M + MA | RA | $\Sigma N_{PPT}$ | TS (MPa) | El (8) | HER (%) | TS × El (MPa %) | TS × HER (MPa %) |
| Inventive example 1 | 5 | 77 | 8 | 10 | 231 | 1240 | 17 | 29 | 21080 | 35960 |
| Inventive example 2 | 6 | 76 | 9 | 9 | 192 | 1221 | 17 | 27 | 20757 | 32967 |
| Inventive example 3 | 9 | 73 | 7 | 11 | 217 | 1217 | 18 | 29 | 21906 | 35293 |
| Inventive example 4 | 6 | 77 | 6 | 11 | 312 | 1249 | 17 | 26 | 21233 | 32474 |
| Inventive example 5 | 7 | 76 | 7 | 10 | 292 | 1283 | 16 | 25 | 20528 | 32075 |
| Inventive example 6 | 6 | 79 | 6 | 9 | 258 | 1255 | 16 | 24 | 20080 | 30120 |
| Inventive example 7 | 9 | 77 | 5 | 9 | 353 | 1211 | 18 | 28 | 21798 | 33908 |
| Inventive example 8 | 7 | 77 | 6 | 10 | 501 | 1253 | 17 | 24 | 21301 | 30072 |
| Inventive example 9 | 9 | 75 | 7 | 9 | 275 | 1209 | 18 | 26 | 21762 | 31434 |
| Comparative example 1 | 5 | 63 | 15 | 17 | 184 | 1297 | 16 | 19 | 20752 | 24643 |
| Comparative example 2 | 25 | 70 | 4 | 1 | 246 | 1098 | 20 | 21 | 21960 | 23058 |
| Comparative example 3 | 14 | 72 | 5 | 9 | 481 | 1021 | 24 | 18 | 24504 | 18378 |
| Comparative example 4 | 23 | 68 | 5 | 4 | 295 | 1150 | 19 | 17 | 21850 | 19550 |
| Comparative example 5 | 5 | 71 | 11 | 13 | 282 | 1310 | 16 | 19 | 20960 | 24890 |
| Comparative example 6 | 17 | 76 | 4 | 3 | 326 | 1137 | 20 | 20 | 22740 | 22740 |
| Comparative example 7 | 6 | 78 | 6 | 10 | 264 | 1267 | 17 | 22 | 21539 | 27874 |
| Comparative example 8 | 14 | 69 | 8 | 9 | 309 | 1176 | 21 | 21 | 24696 | 24696 |
| Comparative example 9 | 5 | 79 | 6 | 10 | 125 | 1242 | 16 | 23 | 19872 | 28566 |
| Comparative example 10 | 7 | 85 | 5 | 3 | 6735 | 1375 | 11 | 22 | 15125 | 30250 |
| Comparative example 11 | 25 | 65 | 5 | 5 | 201 | 1009 | 22 | 24 | 22198 | 24216 |
| Comparative example 12 | 35 | 56 | 4 | 5 | 5839 | 869 | 19 | 19 | 16511 | 16511 |
| Comparative example 13 | 43 | 49 | 4 | 4 | 5763 | 821 | 18 | 19 | 14778 | 15599 |
| Comparative example 14 | 1 | 85 | 12 | 2 | 17 | 1279 | 16 | 21 | 20464 | 26859 |
| Comparative example 15 | 36 | 60 | 1 | 3 | 5714 | 1085 | 14 | 24 | 15190 | 26040 |

(In Table 3, F: ferrite, B: bainite, M: martensite, MA: Martensite-Austenite constituents, RA: retained austenite. ΣNPPT: the number of precipitates in ferrite present within 100 μm from a retained austenite grain boundary per unit area 1 $mm^2$).

As in Table 3, when the composition and manufacturing conditions of the present disclosure were satisfied, high strength of 1180 MPa or more was obtained, TS×El was 20,000 MPa % or more, and TS×HER was 30,000 MPa %, thereby securing excellent formability.

FIG. 1 is a graph illustrating a distribution of TS×El and TS×HER of inventive examples and comparative examples.

Referring to FIG. 1, it has been indicated that excellent physical properties were secured in overall invention examples that satisfied the conditions suggested in the present disclosure.

Figure 2:
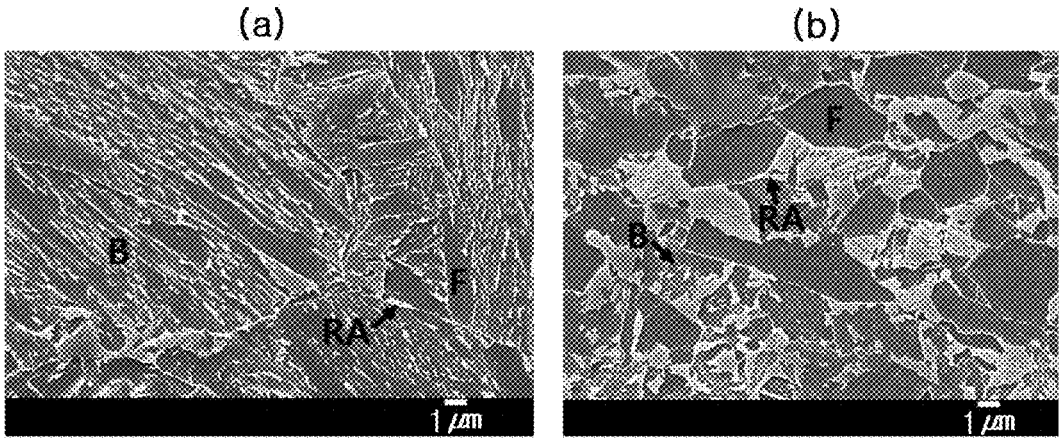
FIGS. 2(*a*) and (*b*) are images of microstructures of inventive example 7 and comparative example 2 respectively in the present Example.

FIGS. 2 (*a*) and (*b*) are images of microstructures of inventive example 7 and comparative example 2, respectively, obtained using an SEM. In inventive example 7, ferrite (F) and retained austenite (RA) were partially included in addition to bainite (B) as a main phase, whereas in comparative example 2, excessive ferrite (F) was formed. Thus, it has been indicated that, in comparative example 2, strength suggested in the present disclosure was not secured.

Figure 3:
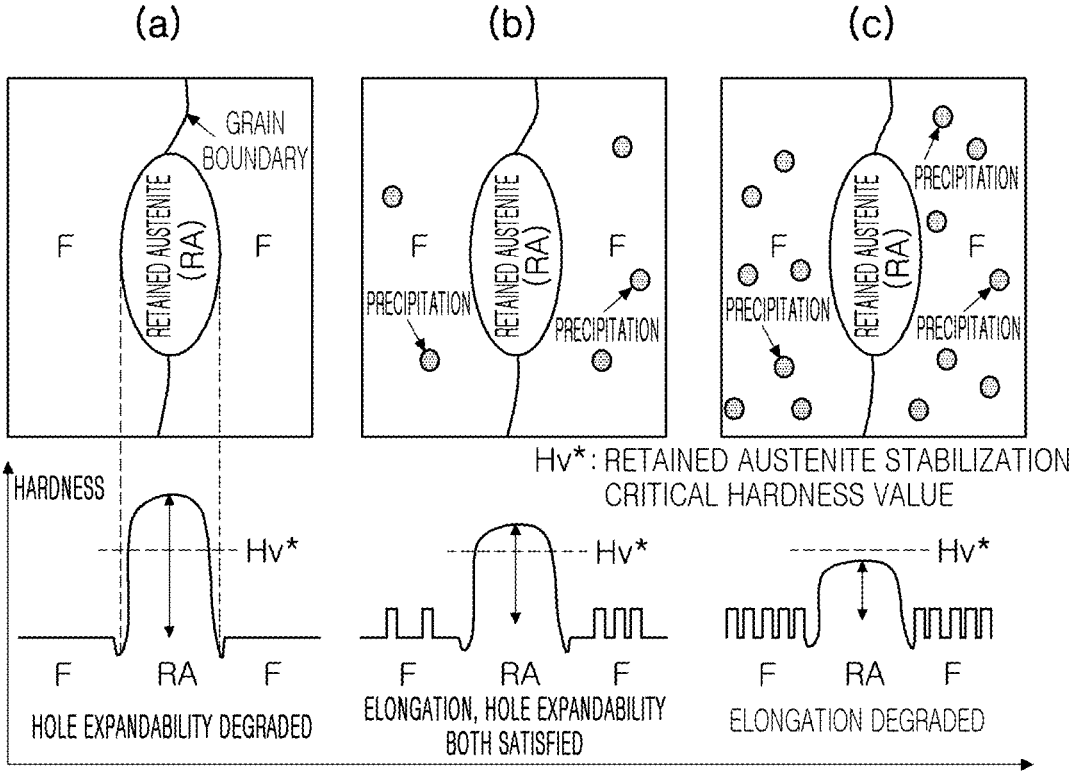
FIGS. 3(*a*), (*b*), and (*c*) are diagrams illustrating a relationship between retained austenite and precipitates in a structure adjacent to the retained austenite of comparative example 14, inventive example 7 and comparative example 15 respectively in the present Example.

FIGS. 3(*a*), (*b*), and (*c*) illustrate precipitation formation behavior in a structure adjacent to retained austenite in comparative example 14, inventive example 7 and comparative example 15, respectively. In FIG. 3 (*a*), it has been indicated that, due to excessive formation of bainite, precipitates in the structure adjacent to retained austenite were rarely formed, whereas, in (c), the secondary cooling was not sufficient, such that excessive precipitates were formed in the structure adjacent to retained austenite, and accordingly, the carbon content for securing stability of retained austenite was insufficient, and elongation was not sufficiently secured.

As shown in Table 3, in comparative examples 1 to 10, the composition of the steel sheet and relational expression 1 or 2 did not satisfy the appropriate range suggested in the present disclosure, and the physical properties suggested in the present disclosure were not secured.

In particular, in comparative examples 9 and 10, the contents of Mo, Ti, Nb, and V were beyond the range suggested in the present disclosure, such that the number of precipitates in a structure adjacent to retained austenite was beyond the effective range suggested in the present disclosure, and accordingly, excellent physical properties was not secured.

In comparative examples 11 to 15, each component satisfied the effective range of the present disclosure, but the finishing temperature after hot rolling and cooling conditions were beyond the effective range suggested in the present disclosure. In these cases, it has been indicated that TS×El and TS×HER suggested in the present disclosure were not secured.

The invention claimed is:

1. A high strength hot-rolled steel sheet having excellent formability, comprising:

by weight %, 0.1-0.15% of C, 2.0-3.0% of Si, 0.8-1.5% of Mn, 0.001-0.05% of P, 0.001-0.01% of S, 0.01-0.1% of Al, 0.7-1.7% of Cr, 0.0001-0.2% of Mo, 0.02-0.1% of Ti, 0.01-0.03% of Nb, 0.001-0.005% of B, 0.1-0.3% of V, 0.001-0.01% of N, and a balance of Fe and inevitable impurities, wherein [relational expression 1] and [relational expression 2] are satisfied, wherein a microstructure of the hot-rolled steel sheet includes, by an area fraction, 5-15% of ferrite, 5-20% of retained austenite, and 10% or less of inevitable structure, in addition to a bainite matrix structure, and wherein tensile strength (TS) is 1180 MPa or more, a product (TS×El) of tensile strength and elongation is 20,000 MPa % or more, and a product (TS×HER) of tensile strength and hole expandability is 30,000 MPa % or more, $$20 \le H\gamma \le 50$$

$$H\gamma = 194.5 - (428[C] + 11[Si] + 45[Mn] + 35[Cr] - 10[Mo] - 107[Ti] - 56[Nb] - 70[V]) \quad \text{[Relational expression 1]}$$

where [elemental symbol] indicates a content (weight %) of each element $$0.7 \le a_p \le 3.5$$

$$a_p = ([Mo]+[Ti]+[Nb]+[V]) \times [C]^{-1} \quad \text{[Relational expression 2]}$$

where [elemental symbol] indicates a content (weight %) of each element.

2. The high strength hot-rolled steel sheet of claim 1, wherein the ferrite has an average hardness value of 200 Hv or more.

3. The high strength hot-rolled steel sheet of claim 1, wherein the inevitable structure is one or more of martensite, martensite austenite constituent (MA), and austenite.

4. The high strength hot-rolled steel sheet of claim 1, wherein, in a microstructure of the hot-rolled steel sheet, the number of precipitates having a diameter of 5 nm or more in ferrite present within 100 μm from a retained austenite grain boundary is $5 \times 10^n/mm^2$ ($1 \le n \le 3$).

5. The high strength hot-rolled steel sheet of claim 4, wherein the precipitates are carbide including one or more of Mo, Ti, Nb and V, or nitride including one or more of Mo, Ti, Nb and V.

6. A high strength hot-rolled steel sheet having excellent formability, comprising:

by weight %, 0.1-0.15% of C, 2.0-3.0% of Si, 0.8-1.5% of Mn, 0.001-0.05% of P, 0.001-0.01% of S, 0.01-0.1% of Al, 0.7-1.7% of Cr, 0.0001-0.2% of Mo, 0.02-0.1% of Ti, 0.01-0.03% of Nb, 0.001-0.005% of B, 0.1-0.3% of V, 0.001-0.01% of N, and a balance of Fe and inevitable impurities, wherein [relational expression 1] and [relational expression 2] are satisfied, wherein, in a microstructure of the hot-rolled steel sheet, the number of precipitates having a diameter of 5 nm or more in ferrite present within 100 μm from a retained austenite grain boundary is $5 \times 10^n/mm^2$ ($1 \le n \le 3$), and wherein tensile strength (TS) is 1180 MPa or more, a product (TS×El) of tensile strength and elongation is 20,000 MPa % or more, and a product (TS×HER) of tensile strength and hole expandability is 30,000 MPa % or more, $$20 \le H\gamma \le 50$$

$$H\gamma = 194.5 - (428[C] + 11[Si] + 45[Mn] + 35[Cr] - 10[Mo] - 107[Ti] - 56[Nb] - 70[V]) \quad \text{[Relational expression 1]}$$

where [elemental symbol] indicates a content (weight %) of each element $$0.7 \le a_p \le 3.5$$

$$a_p = ([Mo]+[Ti]+[Nb]+[V]) \times [C]^{-1} \quad \text{[Relational expression 2]}$$

where [elemental symbol] indicates a content (weight %) of each element.

7. The high strength hot-rolled steel sheet of claim 6, wherein the precipitates are carbide including one or more of Mo, Ti, Nb and V, or nitride including one or more of Mo, Ti, Nb and V.

* * * * *